US005234362A

United States Patent [19]

Breckenfeld et al.

[11] Patent Number: 5,234,362

[45] Date of Patent: Aug. 10, 1993

[54] OUTBOARD MOTOR WITH IMPROVED HOUSING INTERFACE

[75] Inventors: Paul W. Breckenfeld, Kenosha, Wis.; George L. Broughton, Zion, Ill.; David W. Mate, McHenry, Ill.; James A. Nettles, Round Lake, Ill.; Duane E. Rogers, Kenosha, Wis.

[73] Assignee: Outboard Marine Corporation, Waukegan, Ill.

[21] Appl. No.: 823,258

[22] Filed: Jan. 21, 1992

[51] Int. Cl.[5] ..... B63H 1/15

[52] U.S. Cl. ..... 440/76; 440/78; 440/900

[58] Field of Search ..... 440/76, 77, 78, 900, 440/88, 89

[56] References Cited

U.S. PATENT DOCUMENTS

| | | | |
|---|---|---|---|
| 2,021,309 | 11/1935 | Irgens | 440/78 |
| 2,209,301 | 7/1940 | Johnson et al. | 115/18 |
| 3,589,204 | 6/1971 | Langley | 440/78 |
| 4,549,949 | 10/1985 | Guinn | 440/78 |
| 4,583,953 | 4/1986 | Nakase | 440/76 |
| 4,917,639 | 4/1990 | Onoue | 440/78 |
| 5,026,309 | 6/1991 | Onoue | 440/76 |

*Primary Examiner*—Jesus D. Sotelo
*Assistant Examiner*—Stephen P. Avila
*Attorney, Agent, or Firm*—Michael, Best & Friedrich

[57] ABSTRACT

A marine propulsion device comprising an upper housing which has a lower surface and which is adapted to be mounted on the transom of a boat for pivotal movement relative thereto, a lower housing having an upper surface mating with the lower surface, a propeller shaft rotatably supported by the lower housing, and an arrangement for reducing fretting between the lower surface and the upper surface.

19 Claims, 2 Drawing Sheets

Fig. 3
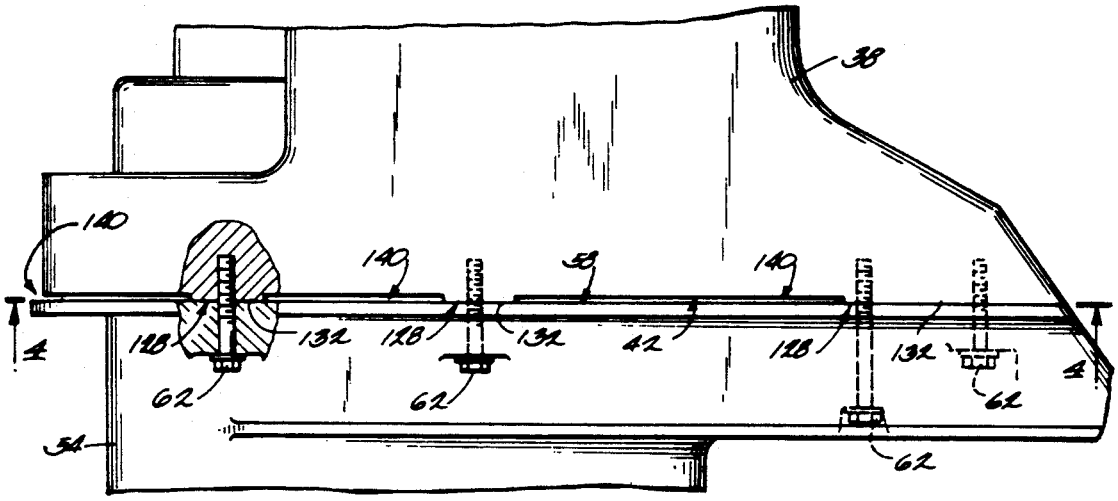
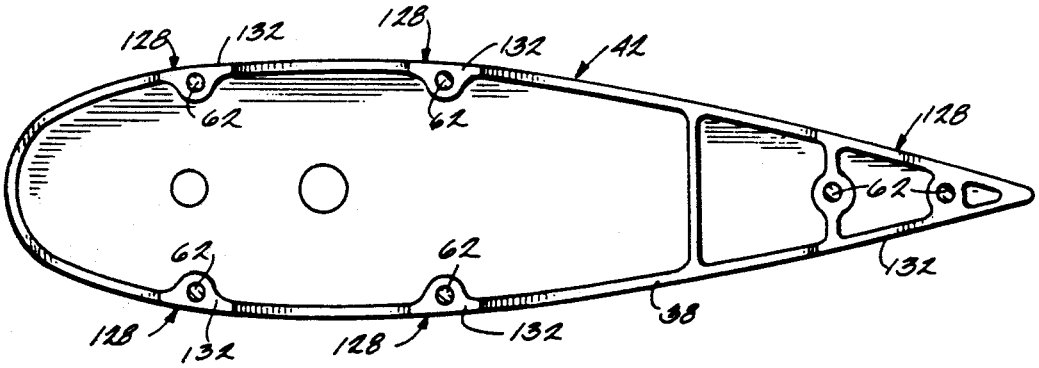
Fig. 4

OUTBOARD MOTOR WITH IMPROVED HOUSING INTERFACE

BACKGROUND OF THE INVENTION

The invention relates to marine propulsion devices, and more particularly to outer exhaust housings for marine propulsion devices such as outboard motors and stern drive units. Still more particularly, the invention relates to the interface between the upper and lower outer exhaust housings of a marine propulsion device.

In a typical outboard motor, the lower surface of the upper outer exhaust housing and the upper surface of the lower outer exhaust housing mate along a generally horizontal plane. In other words, both of these mating surfaces are generally planar and have full contact.

It has been found that the lower surface of the upper housing and the upper surface of the lower housing tend to fret on one another, and this fretting tends to wear away protective coatings, allowing corrosion to occur.

Attention is directed to U.S. Pat. Nos. 2,209,301 and 5,026,309.

SUMMARY OF THE INVENTION

The invention provides a marine propulsion device comprising an upper housing which has a lower surface and which is adapted to be mounted on the transom of a boat for pivotal movement relative thereto, a lower housing having an upper surface mating with the lower surface, a propeller shaft rotatably supported by the lower housing, and means for reducing fretting between the lower surface and the upper surface.

One embodiment of the invention provides a marine propulsion device comprising a first member including a first surface, a second member including a second surface facing the first surface, a propeller shaft supported by the second member, means including projections which are located on the first surface and which engage the second surface for spacing the remainder of the first surface from the second surface, and means including members extending through the projections for connecting the first member to the second member.

One embodiment of the invention provides an outboard motor comprising an upper outer exhaust housing which has a lower surface and which is adapted to be mounted on the transom of a boat for pivotal movement relative thereto, a lower outer exhaust housing having an upper surface mating with the lower surface, one of the upper surface and the lower surface having thereon a plurality of bosses engaging the other of the upper surface and the lower surface, the bosses spacing the remainder of the one of the upper surface and the lower surface from the other of the upper surface and the lower surface, means extending through the bosses for connecting the lower housing to the upper housing, a propeller shaft rotatably supported by the lower housing, an engine supported by the upper housing and drivingly connected to the propeller shaft, an inner exhaust housing which is located within the upper housing, which has an upper end defining an exhaust inlet communicating with the engine, and which has a lower end defining an exhaust outlet, and means for providing a wall of water which is located between the upper housing and the inner exhaust housing and which has a lower end located above the lower surface.

A principal feature of the invention is the provision of means for reducing fretting at the splitline between the upper and lower outer housings. This reduces corrosion at the splitline. The means for reducing fretting preferably includes stand-off bosses on the lower surface of the upper housing. The bosses engage the upper surface of the lower housing, and the remainder of the lower surface of the upper housing is spaced from the upper surface of the lower housing, so that the remainder of the lower surface and the opposed portion of the lower surface are not subject to fretting.

The bosses are machined flat, but the surrounding surface is not machined, allowing cast radii to be left intact. This improves paint application and adhesion. The bolts connecting the mating parts extend through the bosses. As a result, the unit loading on the bosses is very high, and the tendency of the parts to fret on one another is reduced.

Other features and advantages of the invention will become apparent to those of ordinary skill in the art upon review of the following detailed description, claims, and drawings.

DESCRIPTION OF THE DRAWINGS

FIG. 3 is an enlarged, partial side elevational view of the upper outer exhaust housing of the outboard motor.

FIG. 4 is a view taken along line 4—4 in FIG. 3.

Figure 1:
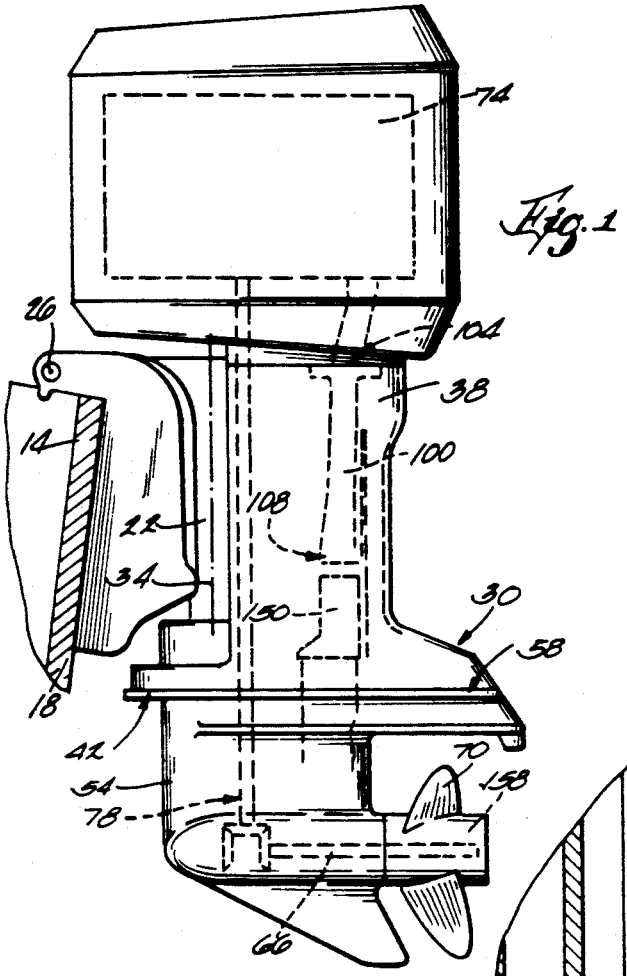
FIG. 1 is a side elevational view of an outboard motor embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device embodying the invention is illustrated in FIG. 1. Although the illustrated marine propulsion device is an outboard motor 10, the invention is also applicable to other types of marine propulsion devices, such as stern drive units.

The outboard motor 10 comprises a transom bracket 14 fixedly mounted on the transom 18 of a boat. A swivel bracket 22 is mounted on the transom bracket 14 for pivotal movement relative thereto about a generally horizontal tilt axis 26. A propulsion unit 30 is mounted on the swivel bracket 22 for pivotal movement relative thereto about a generally vertical steering axis 34.

Figure 2:
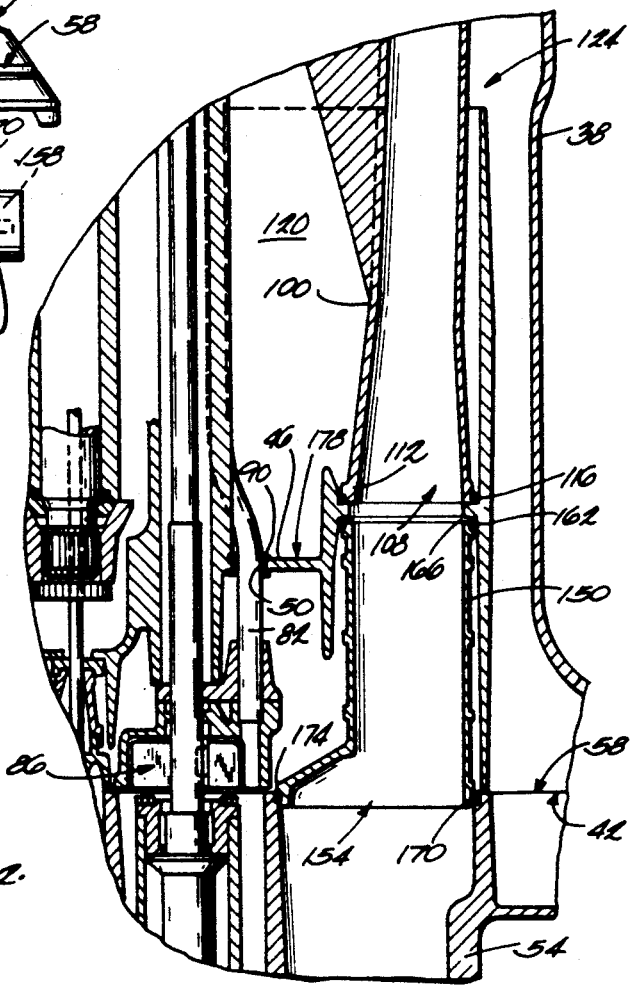
FIG. 2 is a partial sectional view of the outboard motor.

The propulsion unit 30 includes an upper outer exhaust housing or member 38 mounted on the swivel bracket 22 for pivotal movement therewith. The housing 38 is preferably made of cast metal. The housing 38 has (see FIGS. 1–4) a lower surface 42 and includes (see FIG. 2) a generally horizontal wall 46. The reason for the wall 46 is explained below. In the illustrated construction, the wall 46 has therethrough a bore 50.

The propulsion unit 30 also includes (see FIGS. 1 and 2) a lower outer exhaust housing or member 54 having an upper surface 58 mating with the lower surface 42 of the upper housing 38. The lower housing 54 is preferably made of cast metal and is connected to the upper housing 38 by a plurality of bolts or members 62 (FIG.

3). As shown in FIG. 1 a propeller shaft 66 is rotatably supported by the lower housing 54, and a propeller 70 is mounted on the propeller shaft 66. The propulsion unit 30 also includes an engine 74 supported by the upper housing 38 and drivingly connected to the propeller shaft 66 via a conventional drive train 78. A conventional water conduit 82 (FIG. 2) extends through the bore 50 in the wall 46 and conducts water from a pump 86 to the engine 74. A grommet 90 seals the bore 50 around the conduit 82.

The propulsion unit 30 further includes (see FIGS. 1 and 2) an upper inner exhaust housing 100 which is located within the upper housing 38, which has an upper end defining an exhaust inlet 104 communicating with the engine 74, and which has a lower end defining an exhaust outlet 108. More particularly, the lower end of the inner exhaust housing 100 sealingly engages (see FIG. 2) an upwardly facing surface 112 within the outer exhaust housing 38. Preferably, a seal 116 is located between the lower end of the housing 100 and the surface 112. A water jacket or wall of water 120 is located between the upper housing 38 and the inner exhaust housing 100. A conventional dam arrangement 124 within the outer exhaust housing 38 defines the upper end of the wall of water 120. The outer housing wall 46 defines the lower end of the wall of water 120. The grommet 90 substantially prevents water from leaking out of the wall of water 120 through the bore 50.

The outboard motor 10 further comprises means for reducing fretting between the lower surface 42 of the upper housing 38 and the upper surface 58 of the lower housing 54. While various suitable means can be employed, in the illustrated construction, such means includes (see FIGS. 3 and 4), on the lower surface 42 of the upper housing 38, a plurality of standoff bosses or projections 128 having lower surface portions 132 engaging the upper surface 58 of the lower housing 54. Only the lower surface portions 132 of the bosses 128 engage the upper surface 58. In other words, the bosses 128 space the remainder of the lower surface 42 from the upper surface 58. Each of the bosses 128 preferably has a depth or vertical dimension of 0.050 inch.

Preferably, only the lower surface portions 132 of the bosses 128 are machined flat prior to connection of the lower housing 54 to the upper housing 38. The remainder of the lower surface 42 is not machined. This allows cast radii to be left intact and thereby improves paint application and adhesion.

Each of the bolts 62 connecting the lower housing 54 to the upper housing 38 extends through and is threaded into a respective boss 128. This causes the unit loading on the bosses 128 to be very high, and this reduces the likelihood of fretting between the bosses 128 and the upper surface 58.

The bosses 128 create spaces 140 (FIG. 3) between the upper and lower surfaces 58 and 42 in the areas in which the bosses 128 do not engage the upper surface 58. In a prior art outboard motor in which the wall of water extends beneath the splitline between the upper and lower housings, such spaces would allow water to leak out of the wall of water. In order to avoid such leakage, in the outboard motor 10, the lower end of the wall of water 120 is located above the lower surface 42 of the upper housing 38.

The outboard motor 10 preferably further comprises (see FIG. 2) a second or lower inner exhaust housing or boot 150 located within both of the upper and lower housings 38 and 54. The lower inner exhaust housing 150 has an upper end communicating with the exhaust outlet 108, and has a lower end defining a lower exhaust outlet 154 communicating with an exhaust outlet 158 (FIG. 1) in the propeller 70, as is known in the art. In the illustrated construction, a seal 162 is located between the upper end of the housing 150 and a downwardly facing surface 166 within the outer exhaust housing 38. Also, a seal 170 is located between the lower end of the lower housing 150 and an upwardly facing surface 174 within the lower outer exhaust housing 54.

Means are provided for cooling the lower inner exhaust housing 150. While various suitable means can be employed, in the illustrated construction, such means includes at least one opening 178 in the wall 46. The opening 178 communicates with the wall of water 120 and thus allows a small stream of water to flow out of the wall of water 120 and impinge on the housing 150.

Various of the features of the invention are set forth in the following claims:

1. A marine propulsion device comprising a metallic upper housing which has a lower surface and which is adapted to be mounted on the transom of a boat for pivotal movement relative thereto, a metallic lower housing having an upper surface mating with said lower surface, a propeller shaft rotatably supported by said lower housing, and means including metal-to-metal contact of said lower and upper surfaces for reducing fretting between said lower and upper surfaces.

2. A marine propulsion device as set forth in claim 1 and further comprising an engine supported by said upper housing and drivingly connected to said propeller shaft.

3. A marine propulsion device as set forth in claim 2 and further comprising an inner exhaust housing which is located within said upper housing, which has an upper end defining an exhaust inlet communicating with said engine, and which has a lower end defining an exhaust outlet, and means for providing a wall of water which is located between said upper housing and said inner exhaust housing and which has a lower end located above said lower surface.

4. A marine propulsion device comprising an upper housing which has a lower surface and which is adapted to be mounted on the transom of a boat for pivotal movement relative thereto, a lower housing having an upper surface mating with said lower surface, a propeller shaft rotatably supported by said lower housing, and means for reducing fretting between said lower surface and said upper surface, said means including a plurality of bosses located on one of said lower surface and said upper surface and engaging the other of said lower surface and said upper surface.

5. A marine propulsion device as set forth in claim 4 wherein all of said bosses are located on one of said upper surface and said lower surface.

6. A marine propulsion device as set forth in claim 5 wherein all of said bosses are located on said lower surface.

7. A marine propulsion device as set forth in claim 6 wherein said bosses space the remainder of said lower surface from said upper surface.

8. A marine propulsion device as set forth in claim 4 and further comprising means extending through said bosses for connecting said lower housing to said upper housing.

9. A marine propulsion device as set forth in claim 8 wherein said connecting means includes bolts threaded into said bosses.

10. A marine propulsion device as set forth in claim 4 wherein said upper housing is made of cast metal, wherein said bosses include respective lower surface portions partially defining said lower surface, and wherein only said lower surface portions of said lower surface are machined flat prior to connection of said lower housing to said upper housing.

11. A marine propulsion device comprising a first member including a first surface, a second member including a second surface facing said first surface, a propeller shaft supported by said second member, means including projections which are located on said first surface, which extend beyond said first surface, and which engage said second surface for spacing the remainder of said first surface from said second surface, and means including members extending through said projections for connecting said first member to said second member.

12. A marine propulsion device as set forth in claim 11 wherein said connecting means includes bolts threaded into said projections.

13. A marine propulsion device as set forth in claim 11 and further comprising an engine supported by said first member and drivingly connected to said propeller shaft.

14. A marine propulsion device comprising a first member made of cast metal and including a first surface, a second member including a second surface facing said first surface, a propeller shaft supported by said second member, means including projections which include respective surface portions partially defining said first surface, and which engage said second surface for spacing the remainder of said first surface from said second surface, only said surface portions of said first surface are machined flat prior to connection of said first member to said second member, and means including members extending through said projections for connecting said first member to said second member.

15. An outboard motor comprising an upper outer exhaust housing which has a lower surface and which is adapted to be mounted on the transom of a boat for pivotal movement relative thereto, a lower outer exhaust housing having an upper surface mating with said lower surface, one of said upper surface and said lower surface having thereon a plurality of bosses engaging the other of said upper surface and said lower surface, said bosses spacing the remainder of said one of said upper surface and said lower surface from said other of said upper surface and said lower surface, means extending through said bosses for connecting said lower housing to said upper housing, a propeller shaft rotatably supported by said lower housing, an engine supported by said upper housing and drivingly connected to said propeller shaft, an inner exhaust housing which is located within said upper housing, which has an upper end defining an exhaust inlet communicating with said engine, and which has a lower end defining an exhaust outlet, and means for providing a wall of water which is located between said upper housing and said inner exhaust housing and which has a lower end located above said lower surface.

16. An outboard motor as set forth in claim 15 wherein said upper housing includes a generally horizontal wall which is located above said lower surface and which defines said lower end of said wall of water.

17. An outboard motor as set forth in claim 15 wherein said connecting means includes bolts threaded into said bosses.

18. An outboard motor as set forth in claim 15 and further comprising a second inner exhaust housing which is located within at least one of said upper and lower housings, which has an upper end communicating with said exhaust outlet, and which has a lower end defining a second exhaust outlet, and means for cooling said second inner exhaust housing.

19. An outboard motor as set forth in claim 18 wherein said upper housing includes a generally horizontal wall which is located above said lower surface and which defines said lower end of said wall of water, and wherein said cooling means includes an opening which is located in said wall and which communicates with said wall of water.

* * * * *